US008479614B2

(12) United States Patent
Gerwing et al.

(10) Patent No.: US 8,479,614 B2
(45) **Date of Patent: *Jul. 9, 2013**

(54) INTERNALLY RETAINED JAW ROLLER PIN

(75) Inventors: Murray Gerwing, Edmonton (CA); Steven Hargreaves, St. Albert (CA); Jeremy Vaughan, Prince George (CA); Kelvin Isaacson, Edmonton (CA)

(73) Assignee: McCoy Corporation, Edmonton (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/567,914

(22) Filed: Aug. 6, 2012

(65) Prior Publication Data

US 2013/0014612 A1 Jan. 17, 2013

Related U.S. Application Data

(63) Continuation of application No. 12/886,246, filed on Sep. 20, 2010, now Pat. No. 8,234,957.

(60) Provisional application No. 61/244,686, filed on Sep. 22, 2009.

(51) Int. Cl.
*E21B 19/16* (2006.01)
*B25B 17/00* (2006.01)

(52) U.S. Cl.
USPC ..... 81/57.33; 81/57.18; 81/57.2

(58) Field of Classification Search
USPC ..... 81/57.15, 57.18, 57.2, 57.33; 29/525.03
See application file for complete search history.

(56) References Cited

U.S. PATENT DOCUMENTS

| | | | |
|---|---|---|---|
| 4,250,773 | A | 2/1981 | Haynes et al. |
| 5,291,808 | A | 3/1994 | Buck |
| 5,819,605 | A | 10/1998 | Buck et al. |
| 6,237,445 | B1 | 5/2001 | Wesch, Jr. |
| 7,017,450 | B2 | 3/2006 | Bangert |
| 2006/0081091 | A1 | 4/2006 | Wesch, Jr. |

*Primary Examiner* — David B Thomas
(74) *Attorney, Agent, or Firm* — Jones Walker LLP

(57) ABSTRACT

A power tong jaw comprising a jaw body having upper and lower flange sections with flange apertures formed through the upper and lower flange sections. The power tong jaw will further have a jaw roller including a pin aperture and a roller pin positioned through the pin aperture in the jaw roller and through at least one of the upper or lower jaw flange apertures. The power tong jaw will further include a flexible retaining mechanism (i) positioned between outer surfaces of the upper and lower flange and (ii) engaging the roller pin.

27 Claims, 16 Drawing Sheets

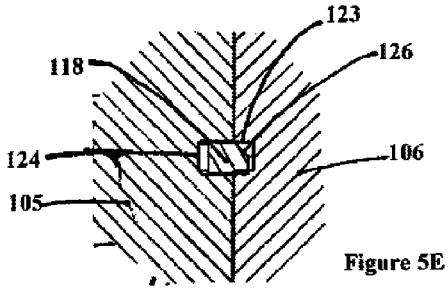
Figure 5E
Figure 6A 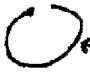 130
135
Figure 6B 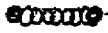 136
Figure 6D 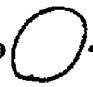 131

INTERNALLY RETAINED JAW ROLLER PIN

CROSS-REFERENCES TO RELATED APPLICATIONS

This is a continuation application of application Ser. No. 12/886,246, filed on Sep. 20, 2010, now U.S. Pat. No. 8,234,957, which claims the benefit of U.S. Provisional Application No. 61/244,686, filed on Sep. 22, 2009, the disclosures of which are hereby incorporated by reference.

I. FIELD OF INVENTION

The present inventions relates to gripping devices used to makeup and breakout drill pipe, casing, and other tubular members. In certain embodiments, the present invention relates to jaw members employed in devices such as power tongs.

II. BACKGROUND OF INVENTION

Power tongs are often employed when connecting or disconnecting tubular members for oilfield applications. Conventional power tongs typically have a ring gear which rotates independently of two cage plates. See for example U.S. Pat. No. 5,291,808. The cage plates are bolted together as one assembly and rotate freely about the body of the tong while the ring gear is connected to the gear train within the tong. Within the ring gear is typically a set of jaw members (or jaws) which are used to grip the tubular section being rotated by the power tong. In most cases, these jaw members include a set of rollers and pins. The rollers engage and rotate against a cam surface on the ring gear, thus, moving the jaw members inward toward the tubular. The rotation of the ring gear causes the jaw members to move inward due to the cage plate assembly being initially held stationary by a brake band or other mechanism. The jaw members engage the tubular and bite until the friction of the brake band holding the cage plates is overcome. Thereafter, the cage plate assembly rotates with the ring gear as one mechanism and applies torque to the tubular.

Example jaw members may be seen in U.S. Pat. Nos. 5,819,605 and 7,017,450 (the '450 patent). FIG. 1A illustrates a rear view of a jaw member 1 having a jaw body 2 with upper and lower flange sections 3A and 3B and a roller cavity 4. Jaw roller 5 fits partially within jaw cavity 4 and roller pin 6 is inserted through the aperture 7 in upper flange section 3A, roller aperture 10, and aperture 7 in lower flange section 3B, thus fixing roller 3 within jaw cavity 4, but allowing roller 3 to rotate relative to jaw body 2. FIG. 1A also illustrates how roller pin 6 has a crown section 8 and upper flange section 3A includes a counter-sunk shoulder 9 so that when roller pin 6 is inserted into jaw member 1, the top surface of crown section 8 is approximately flush with the top surface of upper flange section 3A.

Upper and lower flange sections 3A and 3B can take any shape as long as the flange sections allow a portion of jaw roller 5 to extend from jaw body 2 and engage the ring gear's cam surface. For example, FIG. 7 in the '450 patent illustrates flange sections having a somewhat different shape but serving the same function. Likewise, FIG. 1(*a*) and FIG. 5 of the '450 patent illustrate additional jaw designs and different shapes the flange sections 3A and 3B may take. FIG. 7 of the '450 patent also shows how jaw members 1 will have a gripping surface general opposite jaw roller 5. The gripping surface may take many shapes, but in FIG. 7 of the '450 patent, the gripping surface is formed of strip dies 307.

The jaw and pin combination is used to provide a high strength, low friction mechanism to contact and move along the cam surface of the ring gear. Many conventional jaws may use a retainer mechanism to hold the pin in place while the roller is free to rotate about the pin. Such mechanisms include, but are not limited to, snap rings such as seen in FIG. 1B, screws such as seen in FIG. 1C, and tack welding the pin to the jaw flange (not illustrated). Pins are generally retained against downward movement by way of a crown section. The retainer mechanisms used often prevent axial and rotational movement of the pins (e.g., screws and tack welding). Pins with no retainers other than the crown section may also used which allow for rotational movement of the pin but do not safeguard against the pin being inadvertently knocked upward out of the jaw member (and potentially falling into the well bore).

BRIEF DESCRIPTION OF DRAWINGS

FIGS. 5A to 5E illustrate different embodiments of retainer groove profiles.

FIGS. 6A to 6E illustrate different embodiments of retaining mechanisms.

DETAILED DESCRIPTION OF SELECTED EMBODIMENTS

Figure 1A:
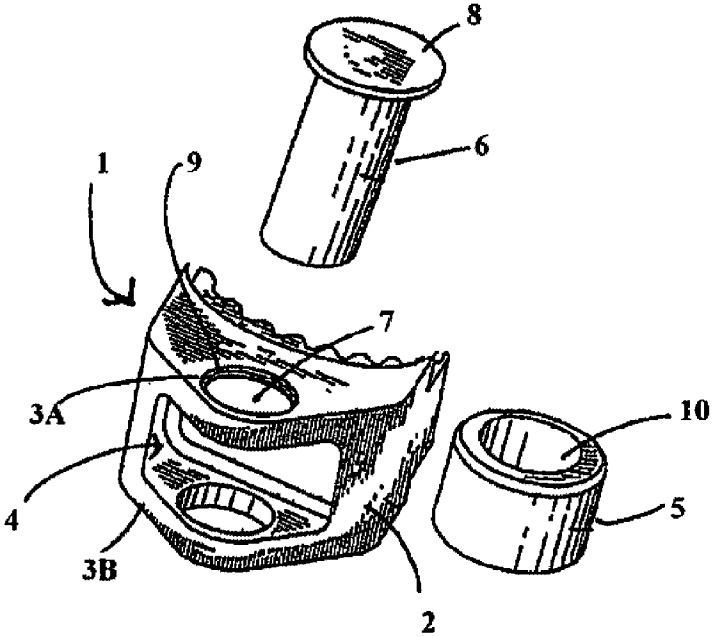
Figure 1A Prior Art
FIGS. 1A to 1C illustrate a prior art jaw members.
Figure 1B:
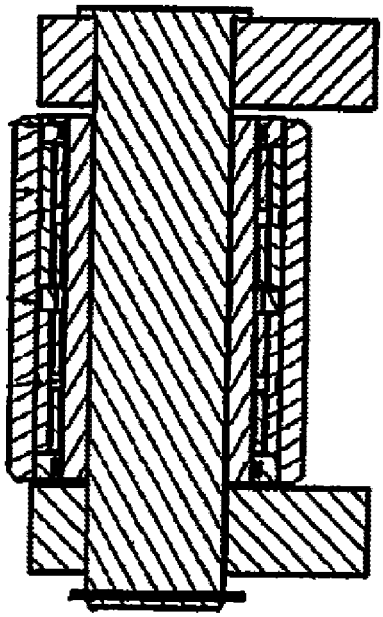
Figure 1B Prior Art
Figure 1C:
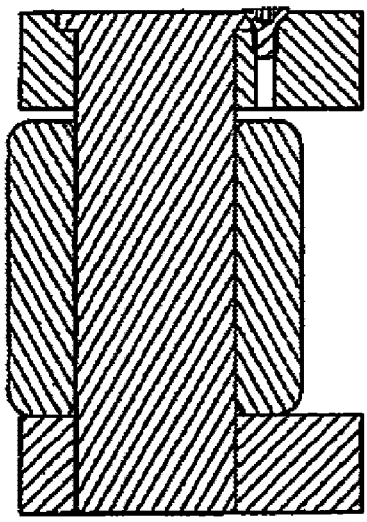
Figure 1C Prior Art
Figure 2:
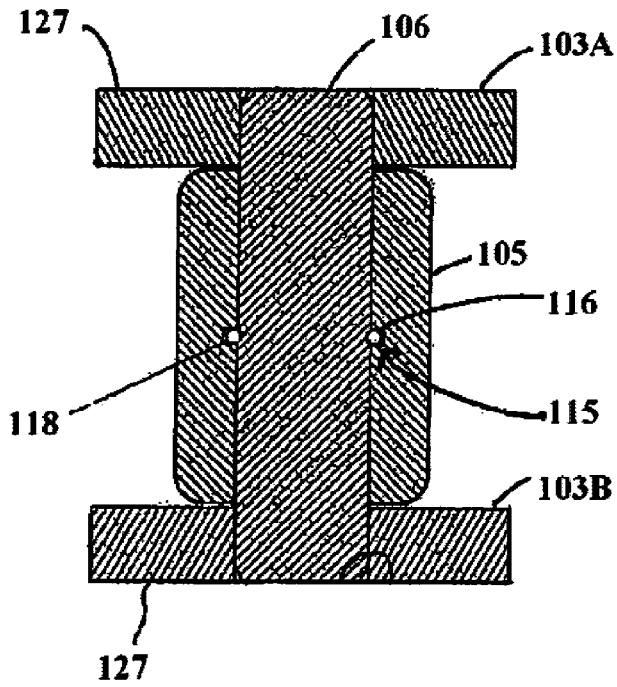
FIG. 2 illustrates one embodiment of the internal roller retainer mechanism of the present invention.

One embodiment of the present invention is seen in FIG. 2, which is a cross-section taken through the upper and lower jaw flanges (or flange sections) 103A and 103B, the jaw roller 105, and the jaw pin 106. Although not specifically shown in FIG. 2, it will be understood that flange sections 103A and 103B are part of a jaw body, one example of which is seen in FIG. 1. However, the jaw body may take on any shape such as seen in U.S. Pat. No. 5,819,605 and the '450 patent or such as found in any other conventional or future developed tong jaws employing a jaw roller. Likewise, the flange sections may take any number of different shapes as long as the flange sections allow the jaw roller to be rotationally fixed to the jaw and exposes a section of the jaw roller to contact with the cam surface of a ring gear. FIG. 2 shows a top surface or outer surface 127 on each of upper and lower flange sections 103A and 103B.

FIG. 2 also illustrates a retaining mechanism 115 positioned between the outer surfaces 127 of upper and lower flange sections 103A and 103B and the retaining mechanism 115 engaging the roller pin 106. In FIG. 2, the retaining mechanism is formed by retaining groove 116 and retaining ring 118. As better seen in FIG. 5A, this embodiment of retaining ring groove 116 comprises pin groove 123 and roller groove 124. In certain embodiments, pin groove 123 and roller groove 124 are approximately the same size (e.g., FIGS. 5A, 5C, and 5D). However, in other embodiments, pin groove 123 could be larger than roller groove 124 (e.g., FIG. 5B) or roller groove 124 could be larger than pin groove 123 (e.g., FIG. 5E).

Figure 5A:
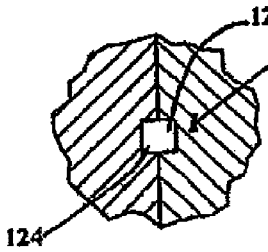
Figure 5C:
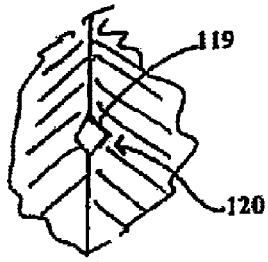
Figure 5B:
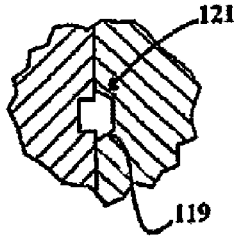
Figure 5D:
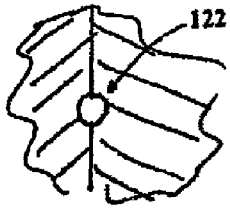

In FIG. 5A, retaining ring groove 116 is generally square shaped, but could take on any number of shapes, nonlimiting examples of which are the trapezoid shaped groove 121 (FIG. 5B), diamond shaped groove 120 (FIG. 5C), or round groove 122 (FIG. 5D). Furthermore, certain embodiments of the retaining groove 116 will have sloped sidewalls 119 (e.g., trapezoid shaped groove 121 and diamond shaped groove 120) which will assist in the disengagement of retaining ring 118 from groove 116. FIG. 5E illustrates another embodiment where the retaining ring 118 has a sloped shoulder 126 while pin groove 123 is generally square. It can be envisioned that prior to insertion of pin 106, retaining ring 118 will be positioned within roller groove 124. As pin 106 is inserted and comes into contact with sloped shoulder 126, shoulder 126 facilitates the expansion of retaining ring 118 and the continued travel of pin 106. However, once retaining ring 118 has engaged pin groove 123, the square lower edge of retaining ring 118 engaging the square pin groove 123 strongly resists any upward force (i.e., in the direction opposite of pin insertion) exerted on pin 106.

The width (or diameter if the groove is generally round) of retaining groove 116 (i.e., the combined width of the groove formed on the pin surface and the roller surface) will be approximately 0.75 inches to 1.5 inches for many embodiments, but the width could be less than 0.75 inches or greater than 1.5 inches in more specialized embodiments.

In the embodiment of FIG. 2, retaining ring 118 is not a completely closed ring or circle, but rather is a broken ring of spring steel such as circular clip or snap ring 130 as in FIG. 6A. Typically the dimensions of snap ring 130 will be such that the ring may be compressed sufficiently that it is completely recessed in the groove formed on the roller pin (or alternatively the groove in the roller), but generally extends around approximately the entire circumference of the roller pin groove. However, the particular dimensions of the snap ring 130 (or other retaining mechanism) is not critical as long as the retaining mechanism can engage the groove on the roller surface and provide resistance to a removal force exerted on the roller pin. Those skilled in the art will recognize that retaining rings could be formed of metals other than steel. In one preferred embodiment, the retaining rings 118 will have a circular cross-section (e.g., FIG. 8A), but retaining rings 118 could also have various alternative cross-sections (e.g., retaining ring 118 seen in FIG. 5E).

One alternative to a metal retaining ring 118 could be formed of an elastic polymer such as rubber O-ring 131 shown in FIG. 6D. In the O-ring example, the cross section of the elastic retaining ring is deformed in order to be forced into retaining groove 116. Both snap ring 130 and O-ring 131 (and detent mechanism 135 discussed below) are nonlimiting examples of flexible retaining mechanisms. In certain embodiments, the retaining mechanism(s) are designed to resist at least approximately 50 lbs. of force on the roller pins before the retaining mechanism disengages and allows the roller pin to be removed from the jaw body. In other embodiments, this force may be at least approximately 75 lbs., 100 lbs., 150 lbs., or a still higher minimum force. In certain embodiments, the polymer material will be harder than conventional rubber (which has a hardness of about 70 on the Shore D scale). For example, the retaining ring could have a hardness ranging from about 80 on the Shore D scale (e.g., a nylon material) to about 110 on the Rockwell R scale (e.g., a polyurethane material). Or alternatively, the hardness of other polymers could range up to 150 Rockwell R (e.g., phenolic materials).

Figure 3:
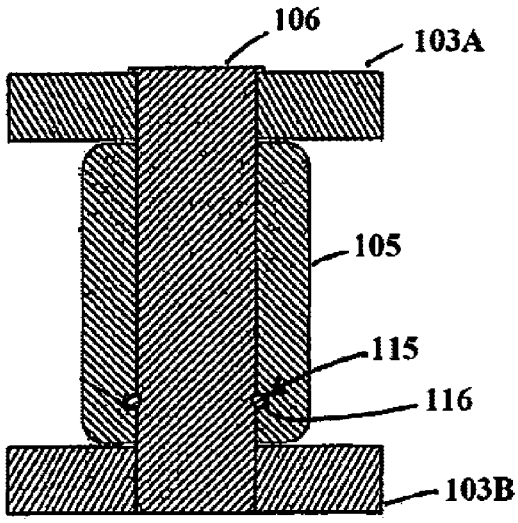
FIG. 3 illustrates a second embodiment of the internal roller retainer mechanism.
Figure 4:
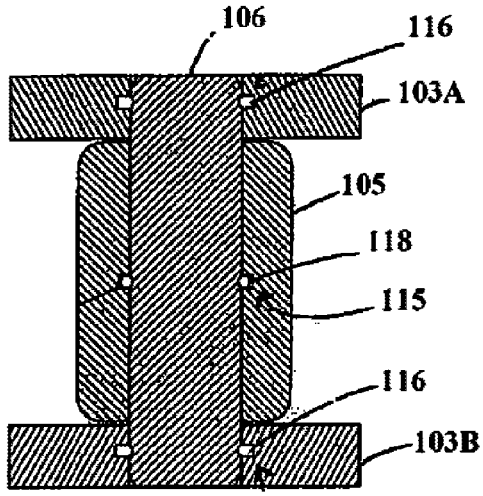
FIG. 4 illustrates a third embodiment of the internal roller retainer mechanism.

The position of retaining mechanism 115 can vary greatly depending on the particular embodiment. In the embodiments seen in the drawings, retaining mechanism 115 is positioned somewhere between the outer surface 127 of upper flange 3A and the outer surface 127 of lower flange 3B. For example, FIG. 3 shows a retaining groove 116 positioned on a lower portion of jaw roller 105. FIG. 4 shows multiple positions where retaining grooves 116 could be positioned along the length of roller pin 106. In FIG. 4, one retaining groove 116 is formed along the interior surface of jaw roller 105 while other retaining grooves 116 are positioned along the interior surface of the apertures in upper and lower flanges 3A and 3B. FIG. 8 shows a retaining groove 116 positioned below flange section 103A, but above jaw roller 105. In the embodiment of FIG. 8, retaining groove 116 consists only of pin groove 123 on roller pin 106 and does not have a corresponding roller groove as in FIGS. 5A to 5D discussed above. Thus, there are embodiments of the retaining groove 116 that comprise only a groove in roller pin 106 or only a groove in roller 105.

Figure 8A:
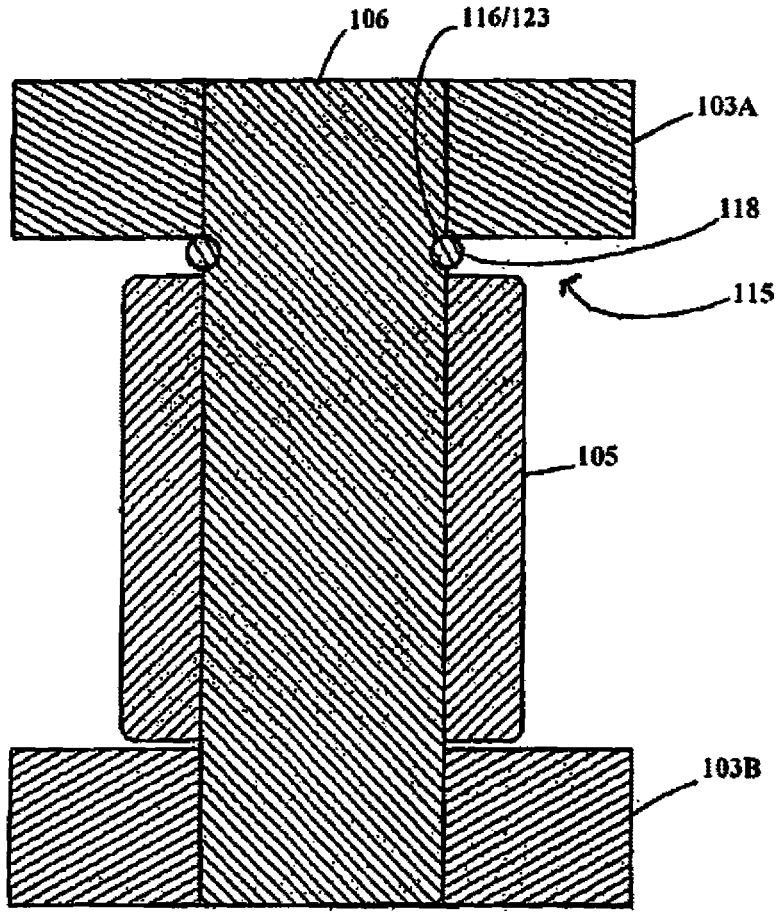
FIG. 8A illustrates a fifth embodiment of the internal roller retainer mechanism.
Figure 8B:
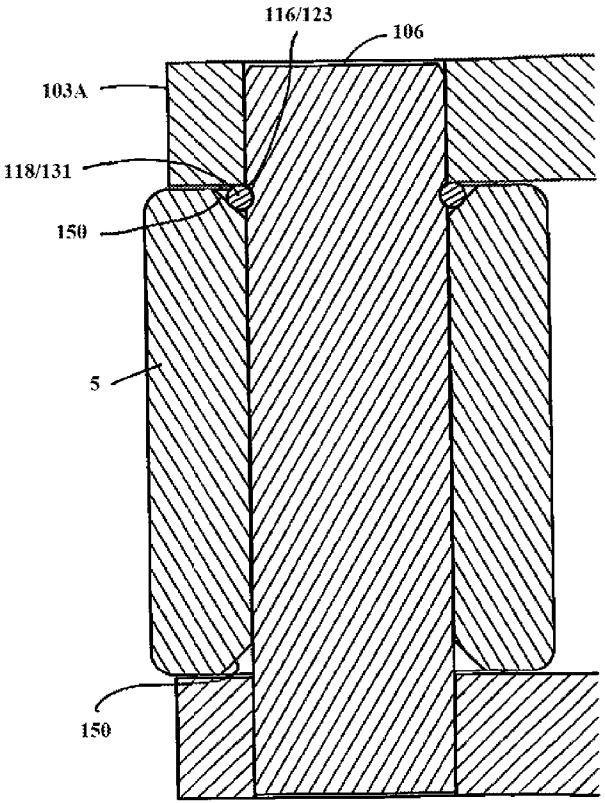
FIG. 8B illustrates a modification of the embodiment of FIG. 8A.

FIG. 8B illustrates a modification of the FIG. 8A embodiment. The retaining groove 116 is formed by a pin groove 123 and a sloping shoulder 150 formed on the inside diameter of jaw roller 5 at the end of jaw roller 5 adjacent to retaining ring 118. The embodiment of FIG. 8B shows the sloping shoulder 150 formed on both ends of jaw roller 5, but other embodiments could have the sloping shoulder only on the jaw end adjacent to retaining ring 118. The embodiment illustrated has a sloping shoulder of approximately 45°, but other shoulder slopes could be employed (e.g., ranging from about 30° to about 60°). In the embodiment of FIG. 8B, retaining ring 118 is preferably a polymer ring with a hardness falling within the range mentioned above. Likewise, this embodiment illustrates the length of jaw roller 5 being such that retaining ring is in contact with or near contact with flange 103A, sloping shoulder 150, and pin groove 123.

Figure 9:
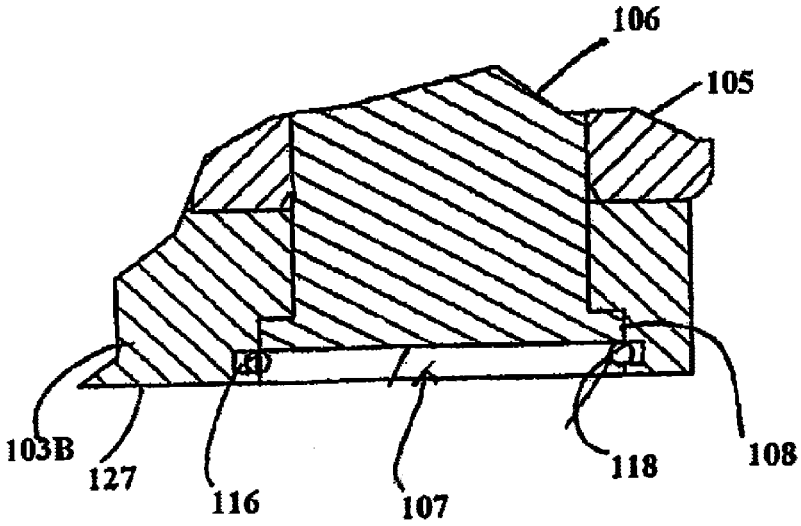
FIG. 9 illustrates a sixth embodiment of the internal roller retainer mechanism.

A still further embodiment is seen in FIG. 9. In this figure, roller pin 106 has a crown section 108 which has been counter-sunk into flange aperture 107. The retaining groove 116 is formed in flange aperture 107 above the outer surface 127 of flange section 103B, but below the crown section 108. Retaining ring 118 is sized to engage both retaining groove 116 and crown section 108, thereby preventing the removal of roller pin 106 until the retaining ring 118 is removed or expanded completely into retaining groove 116. Comparing FIGS. 8 and 9, it can be seen how some embodiments of roller pin 106 have a crown section 108 while other embodiments do not have the crown section. FIG. 8 suggests how both ends of roller pin 106 may have chamfered ends 125 (see FIG. 11). In general, the internal retaining mechanism of the present invention may be employed with any conventional or future developed retaining pins.

Figure 6C:
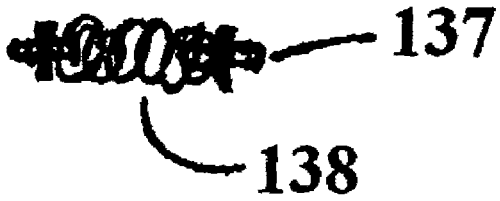
Figure 6E:
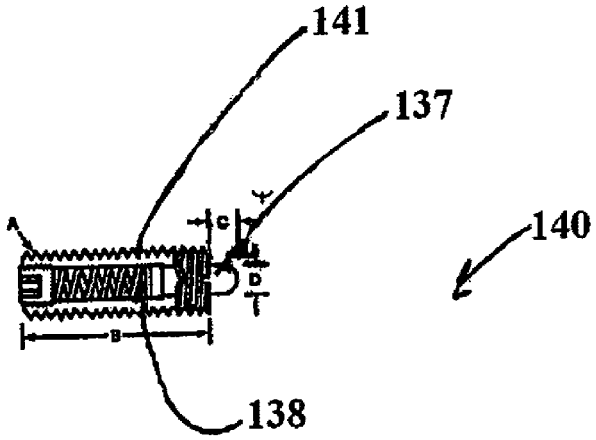
Figure 7:
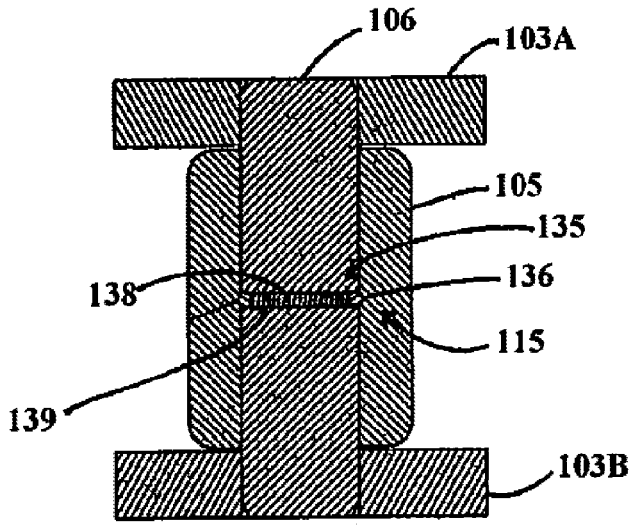
FIG. 7 illustrates a fourth embodiment of the internal roller retainer mechanism.

FIG. 7 illustrates an example where the retaining mechanism 115 is a detent mechanism 135. In this embodiment, detent mechanism 135 is formed by a detent aperture 139 extending through roller pin 106 with detent spring 108 positioned therein to bias detent spheres 136 outward. FIG. 6B shows a detent mechanism 135 with detent spheres 136 while FIG. 6C shows a detent mechanism with detent pins 137. Moreover, any other conventional or future developed detent mechanism is considered within the scope of the present invention. Although FIG. 7 shows detent aperture 139 extending completely though roller pin 106, other embodiments could have detent apertures 139 only partially extending into roller pin 106. This would allow for the use of only one detent sphere or more than two detent spheres by spacing the detent apertures around the circumference of roller pin 106. And while more difficult to manufacture, the detent aperture 139 (together with spring 138 and sphere 136 or pin 137) could also be positioned in the jaw roller 105. A still further embodiment such as seen in FIG. 6E could utilize a threaded detent mechanism 140. This detent mechanism includes a threaded outer body 141 having an internal spring 138 and detent pin 137. One or more detent mechanisms 140 typically would be threaded into a bore in roller pin 106. One exemplary detent mechanism is manufactured by McMaster-Carr, Inc. of Aurora, Ohio. Naturally the detent aperture could be positioned elsewhere along the length of roller pin 106 such as seen in FIGS. 3 and 4.

Figure 10:
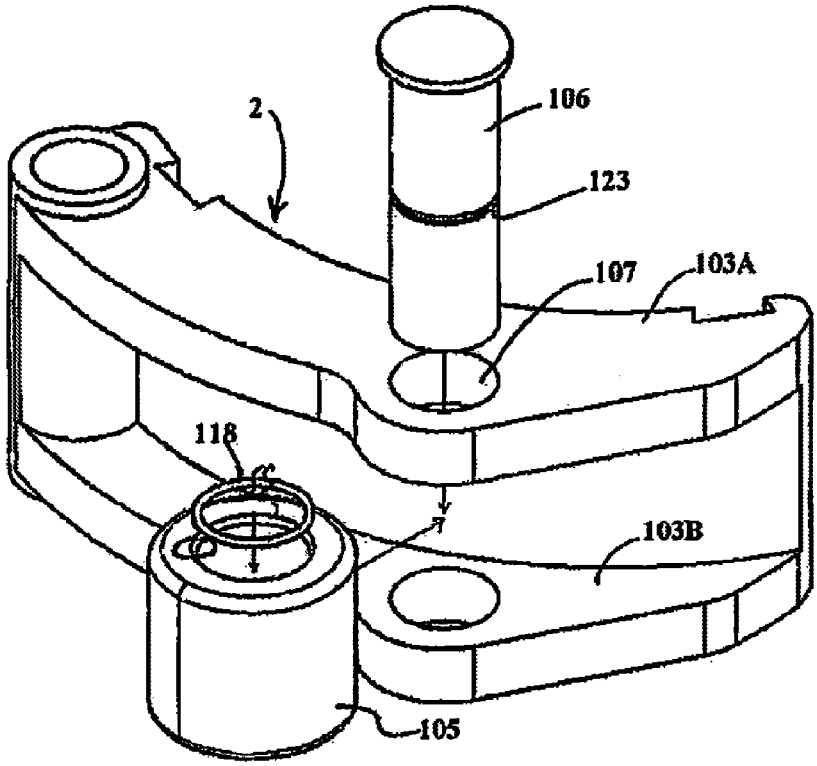
FIG. 10 illustrates one method of securing an internal roller retainer mechanism into a jaw member.
Figure 11:
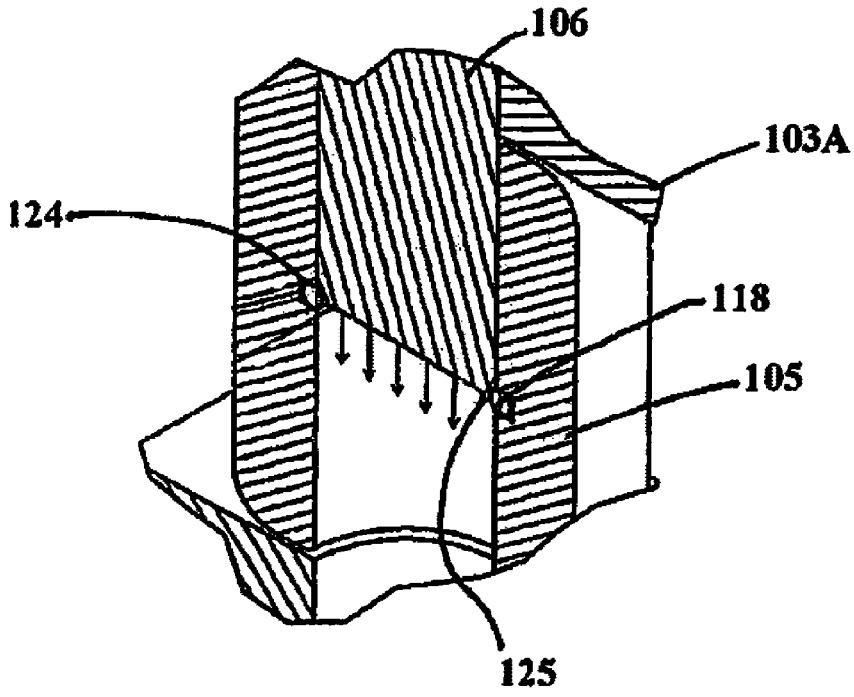
FIG. 11 illustrates a chamfered roller pin end acting on a retainer ring.

FIGS. 10 and 11 illustrate how one embodiment of the retaining mechanism would operate to secure the roller to a jaw body 2. In FIG. 10, the jaw body 2 is shown just prior to roller 105 being inserted between jaw flanges 103A and 103B such that roller pin 106 may be inserted through the roller center aperture. Retaining ring 118 will be positioned at the top of the roller center aperture prior to roller 105 being inserted between the jaw flanges. Alternatively, retaining ring 118 could be inserted at the top of the flange aperture 107. As roller pin 106 is inserted through the flange aperture 107, the leading edge of roller pin 106 forces retaining ring 118 down the inside surface of jaw roller 105. As best seen in FIG. 11, retaining 118 will ultimately engage and become lodged within roller groove 124. It can be seen that this embodiment of roller pin 106 has a chamfered end 125 which will assist the lead end of roller 106 in expanding retaining ring 118 and moving past the retaining ring without dislodging it from roller groove 124. It will be understood that as pin groove 123 (seen in FIG. 10) becomes aligned with retaining ring 118, the retaining ring will engage pin groove 123 and thereby "lock" the roller pin 106 into place such that it is not dislodged from jaw body 2 by routine removal forces encountered in normal operations of the jaw member 1.

Figure 12:
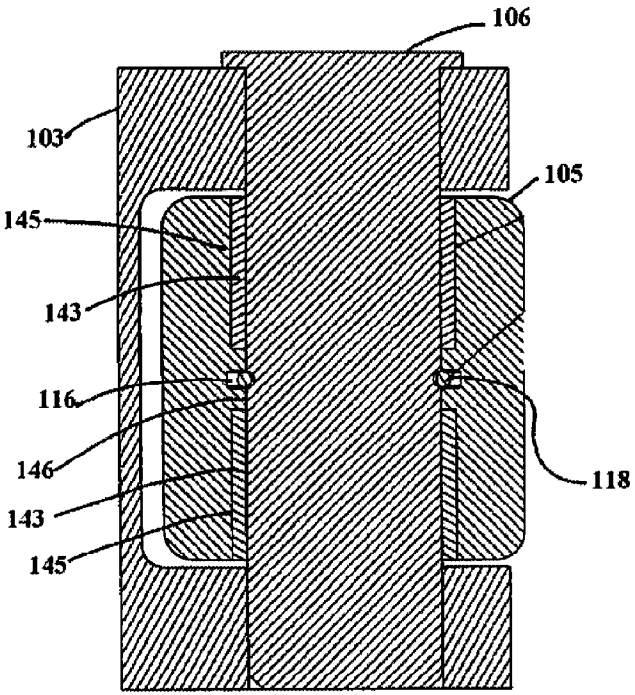
FIG. 12 illustrates a seventh embodiment of the internal roller retainer mechanism.

FIG. 12 illustrates another embodiment of the retaining mechanism which additionally utilizes a friction reducing surface between the pin and roller. Nonlimiting examples of such friction reducing surfaces are disclosed in U.S. Pat. No. 5,819,605 which is incorporated by reference herein. In the example of FIG. 12, roller 105 includes two enlarged inner diameter sections 145 sized to receive low friction sleeves 143. The mid portion of roller 105 further includes a retaining pin collar 146 having retaining pin groove 116 formed therein. It can be seen how this arrangement results in the great majority of the contact area between the pin and roller being born by the low friction sleeves 143. In the embodiment shown, the sleeve 143 is a Teflon coated metal sleeve, but could be any low friction surface disclosed in U.S. Pat. No. 5,819,605 or any other conventional or future developed low friction surface.

One general embodiment is a power tong jaw comprising a jaw body having supper and lower flange sections with flange apertures formed through the upper and lower flange sections. The power tong jaw will further have a jaw roller having a pin aperture and a roller pin positioned through the pin aperture in the jaw roller and through at least one of the upper or lower jaw flange apertures. The power tong jaw will further include a flexible retaining mechanism (i) positioned between outer surfaces of the upper and lower flange and (ii) engaging the roller pin.

One alternative to this embodiment provides that the retaining mechanism includes a sloped surface formed on at least one of a groove on the roller pin or a groove on the inside diameter of the roller. Another alternative to the above embodiment provides that the groove formed on the roller pin and the groove formed on the roller are of different sizes. As a still further alternative, the retaining ring could be of a polymer material having a hardness ranging from about 80 Shore D scale to about 150 Rockwell R scale (or any subrange therebetween).

Although several particular embodiments have been used to describe the present invention, those skilled in the art will see many obvious modifications and variations of the above described embodiments. All such modifications and variations are intended to fall within the scope of the following claims.

The invention claimed is:

1. A power tong jaw comprising:

a. a jaw body having upper and lower flange sections with flange apertures formed through said upper and lower flange sections;

b. a jaw roller having a pin aperture;

c. a roller pin positioned through said pin aperture in said jaw roller and through at least one of said upper or lower jaw flange apertures; and d. a flexible retaining mechanism (i) positioned between outer surfaces of said upper and lower flange and (ii) engaging said roller pin; and e. said retaining mechanism comprising a groove, wherein a portion of said groove is formed on said roller pin and a portion of said groove is formed on an inside surface of said roller.

2. The power tong jaw according to claim 1, wherein said retaining mechanism comprises a retaining ring engaging a groove formed in said roller pin and a groove formed in an internal wall of said jaw roller.

3. The power tong jaw according to claim 2, wherein said retaining mechanism comprises multiple retaining rings.

4. The power tong jaw according to claim 2, wherein said retaining ring is a snap ring.

5. The power tong jaw according to claim 1, wherein said retaining mechanism comprises a retaining ring engaging a groove formed in said roller pin and a groove formed in at least one of said flange sections.

6. The power tong jaw according to claim 1, further comprising a gap between an end of said jaw roller and at least one of said flange sections, wherein said retaining mechanism engages said roller pin along said gap.

7. The power tong jaw according to claim 1, wherein said retaining mechanism comprises a spring loaded detent formed in said roller pin.

8. The power tong jaw according to claim 7, wherein said detent comprises a ball or pin biased in a radial outward direction.

9. The power tong jaw according to claim 1, wherein:

i) a counter-sunk shoulder is formed in at least one flange aperture;

ii) said roller pin comprises a crown section which abuts said shoulder; and iii) said retaining mechanism is positioned between a top of said flange aperture and said roller pin crown section.

10. The power tong jaw according to claim 9, wherein said retaining mechanism comprises a retaining ring.

11. The power tong jaw according to claim 1, wherein said roller pin has at least one chamfered end.

12. The power tong jaw according to claim 11, wherein said roller pin has two chamfered ends.

13. The power tong jaw according to claim 11, wherein said roller pin has no crown section.

14. The power tong jaw according to claim 1, wherein a rear portion of said jaw body comprises said flange sections and a front portion of said jaw comprises at least one die insert having a gripping surface formed thereon.

15. The power tong jaw according to claim 1, wherein a groove is formed on said roller pin.

16. The power tong jaw according to claim 1, wherein said groove comprises sloped shoulder sections.

17. The power tong jaw according to claim 1, further comprising at least one friction reducing surface positioned on opposing sides of said retaining mechanism.

18. A method of securing a roller within a power tong jaw member, comprising the steps of:

(a) positioning a retaining mechanism between a flange aperture and a roller pin; and (b) inserting a roller pin into said flange aperture.

19. The method according to claim 18, wherein said roller pin is inserted until said retaining mechanism engages a groove on said roller pin and a groove within said pin aperture.

20. The method according to claim 18, the power tong jaw member comprising:

(a) a jaw body having upper and lower flange sections with said flange apertures formed through said upper and lower flange sections;

(b) a jaw roller having a pin aperture;

(c) said roller pin; and (d) said retaining mechanism.

21. The method according to claim 18, wherein the retaining mechanism is flexible.

22. The method according to claim 18, further comprising the step of moving said retaining mechanism along with said roller pin.

23. The method according to claim 18, wherein said groove is in said roller pin.

24. The method according to claim 18, wherein said groove is in a jaw roller.

25. The method according to claim 18, wherein said groove is in at least one flange section.

26. A power tong jaw comprising:

a. a jaw body having upper and lower flange sections with flange apertures formed through said upper and lower flange sections;

b. a jaw roller having a pin aperture;

c. a roller pin positioned through said pin aperture in said jaw roller and through at least one of said upper or lower jaw flange apertures;

d. a flexible retaining mechanism (i) positioned between outer surfaces of said upper and lower flange and (ii) engaging said roller pin; and e. wherein said roller pin has at least one chamfered end.

27. A power tong jaw comprising:

a. a jaw body having upper and lower flange sections with flange apertures formed through said upper and lower flange sections;

b. a jaw roller having a pin aperture;

c. a roller pin positioned through said pin aperture in said jaw roller and through at least one of said upper or lower jaw flange apertures;

d. a flexible retaining mechanism (i) positioned between outer surfaces of said upper and lower flange and (ii) engaging said roller pin; and e. at least one friction reducing surface positioned on opposing sides of said retaining mechanism.

* * * * *